US007125282B2

(12) United States Patent
Huang

(10) Patent No.: US 7,125,282 B2
(45) Date of Patent: Oct. 24, 2006

(54) ADAPTER MODULE FOR PORTABLE COMPUTER

(75) Inventor: Wen-Tsung Huang, Taipei (TW)

(73) Assignee: ASUSTeK Computer Inc., Taipei (TW)

( * ) Notice: Subject to any disclaimer, the term of this patent is extended or adjusted under 35 U.S.C. 154(b) by 0 days.

(21) Appl. No.: 11/227,250

(22) Filed: Sep. 16, 2005

(65) Prior Publication Data

US 2006/0172591 A1 Aug. 3, 2006

(30) Foreign Application Priority Data

Feb. 1, 2005 (TW) ..... 94103120 A

(51) Int. Cl.
*H01R 13/72* (2006.01)

(52) U.S. Cl. ..... 439/501; 191/12.4; 191/12.2 R

(58) Field of Classification Search ..... 439/501; 191/12.4, 12.2 R
See application file for complete search history.

(56) References Cited

U.S. PATENT DOCUMENTS 5,701,981 A * 12/1997 Marshall et al. ..... 191/12.4
5,718,310 A * 2/1998 Gallo ..... 191/12.2 R
6,619,449 B1 * 9/2003 Liao ..... 191/12.2 R
6,733,328 B1 * 5/2004 Lin et al. ..... 439/501
6,874,722 B1 * 4/2005 Wei ..... 242/378

* cited by examiner

*Primary Examiner*—Truc Nguyen
(74) *Attorney, Agent, or Firm*—Birch, Stewart, Kolasch & Birch, LLP

(57) ABSTRACT

An adapter module for a portable computer keeps its power cables in its housing to maintain a tidy appearance. Cylinders, driven by torsion springs, roll power cables around themselves in the housing. A stop, driven by a spring, blocks teeth of cylinders to prevent the cylinders from rolling up the power cables. A button, operated by a user, is pushed against the stop to release the cylinders on which the power cables are retracted. When the adapter module is used to transmit power, power cables of desired length are extracted. When the module is not in use, the button is pressed to tract the power cables into the housing.

14 Claims, 3 Drawing Sheets

ADAPTER MODULE FOR PORTABLE COMPUTER

RELATED APPLICATIONS

The present application is based on, and claims priority from, Taiwan Application Serial Number 94103120, filed Feb. 1, 2005, the disclosure of which is hereby incorporated by reference herein in its entirety.

BACKGROUND

1. Field of Invention

The present invention relates to an adapter module. More particularly, the present invention relates to an adapter module for a portable computer.

2. Description of Related Art

A portable computer can use at least two power sources. Usually, a portable computer uses a built-in battery as a power source. A portable computer can also use an adapter, either as a power source or to charge the battery thereof.

An adapter has two ends, which are power cables and their plugs, electrically connected to a power source and a portable computer, respectively. However, power cables of fixed length are difficult to organize for use and storage. An adapter, when not in use, may occupy a large space if the power cables thereof are not properly organized. Thus, use of an adapter to provide power to a portable computer is somewhat inconvenient.

SUMMARY

It is therefore an objective of the present invention to provide an adapter module for a portable computer that allows careful organization of power cables.

In accordance with the foregoing and other objectives of the present invention, an adapter module for a portable computer retains power cables thereof in a housing thereof, thereby maintaining a tidy appearance. Cylinders, driven by torsion springs, roll power cables around themselves in the housing. A stop, driven by a spring, blocks teeth of the cylinders so that the cylinders are prevented from rolling the power cables. A button, operated by a user, is pushed against the stop to release the cylinders when the power cables are retracted. When the adapter module is used to transmit power, the power cables are pulled out to a desired length. When the module is not in use, the button is pressed to retract the power cables into the housing.

Thus, the adapter module for portable computer can retract its power cables by cylinder rolling function. When the adapter module is in use, power cables are pulled out to a desired length and unused portions of power cables are kept in the housing. When the power cables have been retracted, the plugs are stored in concavities thereof so as to reduce effectively an overall volume thereof.

It is to be understood that both the foregoing general description and the following detailed description are examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1A:
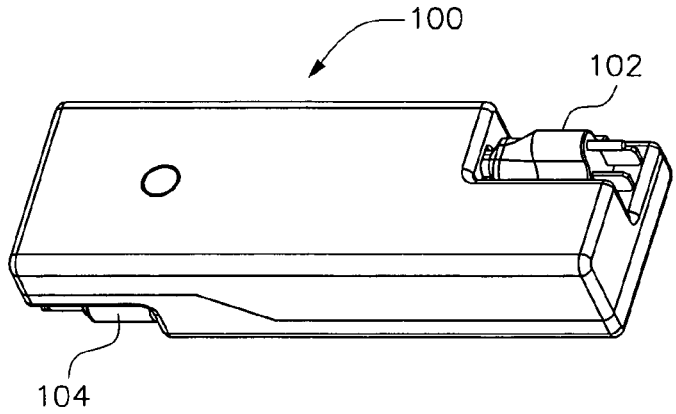
FIG. 1A is a schematic, perspective view of an adapter module according to one preferred embodiment of this invention, with the plugs stored.

Reference will now be made in detail to the present preferred embodiments of the invention, examples of which are illustrated in the accompanying drawings. Wherever possible, the same reference numbers are used in the drawings and the description to refer to the same or like parts.

In order to overcome the convenience of using a conventional adapter for a portable computer, an inventive adapter module has been provided. By keeping unused lengths of power cables in a housing, and pulling the power cables out to a desired length, power cables of an adapter can be organized well.

FIG. 1A is a schematic, perspective view of an adapter module according to one preferred embodiment of this invention, with the plugs retracted. When power cables have been retracted into an adapter module 100, plugs 102 and 104 are respectively accommodated in concavities of a housing thereof. The adapter module 100 is therefore tidy in appearance, and an overall storage volume of the adapter module 100 is reduced.

Figure 1B:
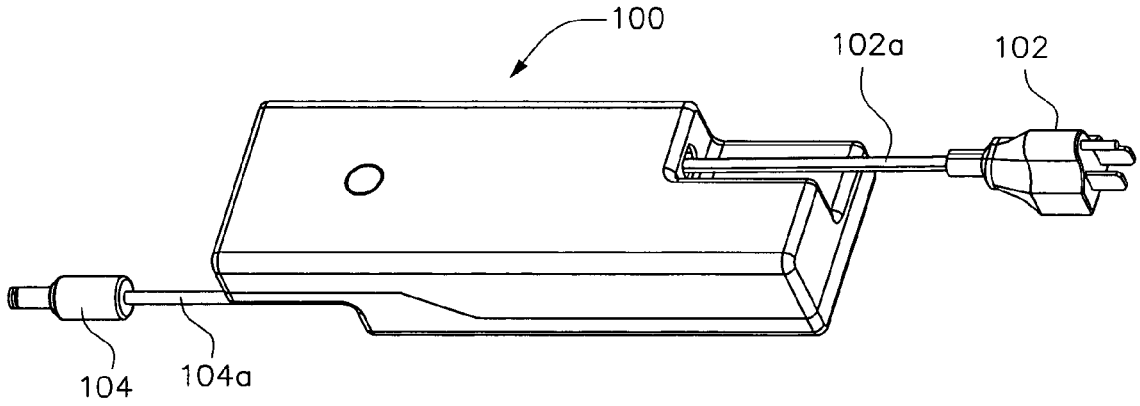
FIG. 1B is a schematic, perspective view of an adapter module according to one preferred embodiment of this invention, with the plugs have been pulled out.

FIG. 1B is a schematic, perspective view of an adapter module according to one preferred embodiment of this invention, with the plugs pulled out. When the adapter module is in use, plugs 102 and 104 are pulled to extract power cables 102*a* and 104*a*, respectively. Because unused portions of power cables 102*a* and 104*a* are retained in the housing, the adapter module is organized well.

Figure 2:
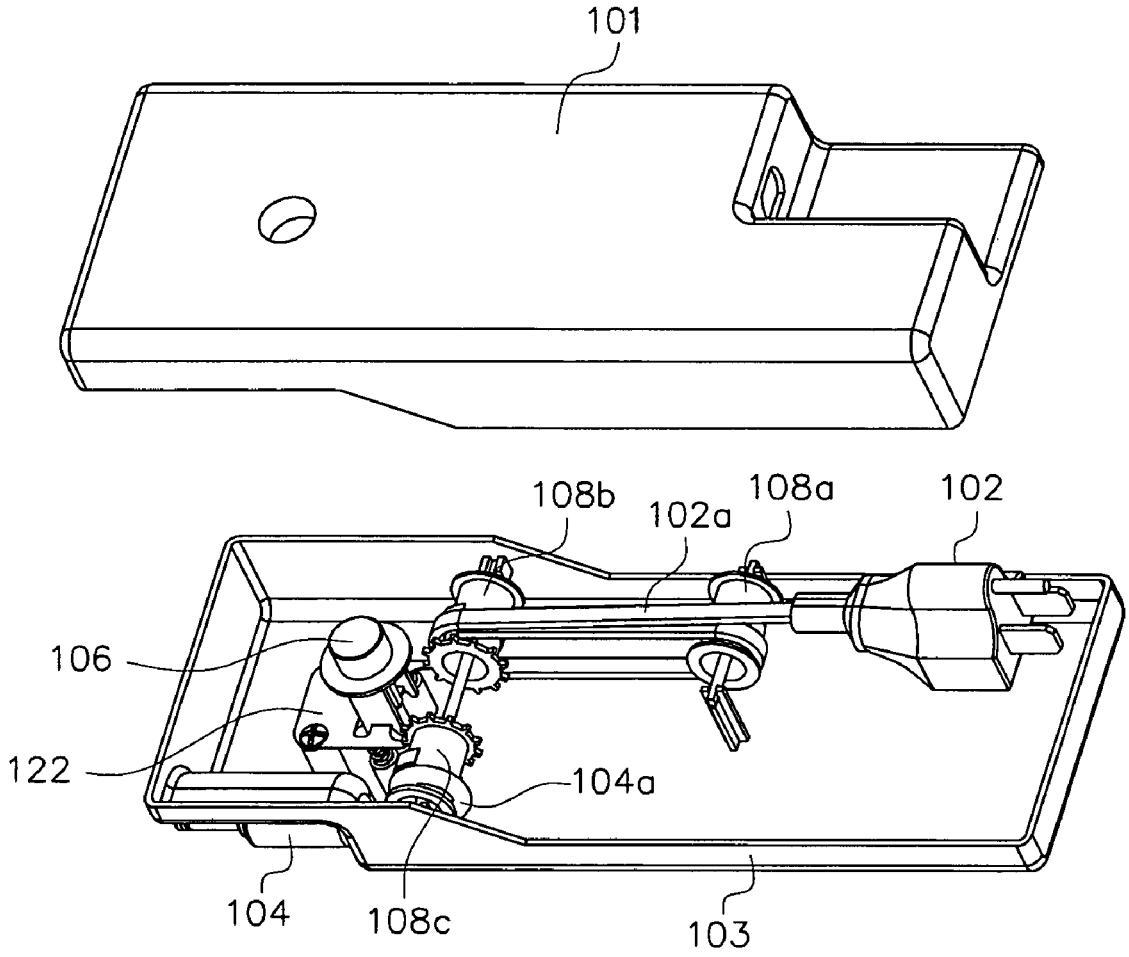
FIG. 2 is a schematic, perspective view of an adapter module according to one preferred embodiment of this invention, with an upper housing removed from an lower housing.

FIG. 2 is a schematic, perspective view of an adapter module according to one preferred embodiment of this invention, with an upper housing removed from a lower housing thereof. An unused portion of the power cable 102*a* is rolled around cylinders 108*a* and 108*b* in the housing. An unused portion of the power 104*a* is rolled around the cylinder 108*c* in the housing. Cylinders 108*a* and 108*c*, equipped with teeth, are secured to a lower housing 103 by the same rotation shaft. Cylinders 108*a*, 108*b* and 108*c* are driven by torsion springs to roll power cables around themselves and are blocked by a stop 122 to stop rotating (when the adapter module is in use). The stop 122 is controlled by a button 106. When a user presses the button 106, the stop 122 is released from cylinders 108*b* and 108*c* so power cables 102*a* and 104*a* are rolled around cylinders in the housing.

Figure 3:
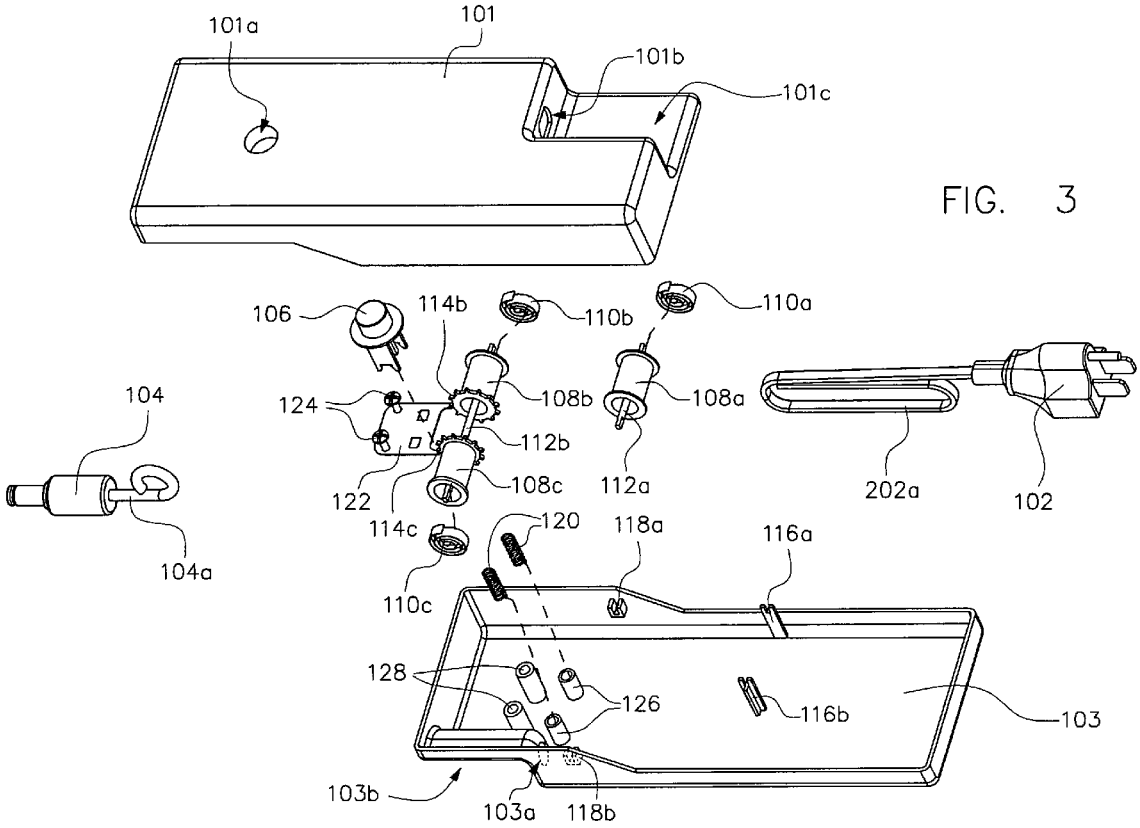
FIG. 3 is a schematic, exploded view of an adapter module according to one preferred embodiment of this invention.

FIG. 3 illustrates an exploded view of an adapter module according to one preferred embodiment of this invention. The housing of the adapter 100 can be divided into an upper housing 101 and a lower housing 103. The upper housing 101 has a hole 101*a* to expose an button 106, and has another hole 101*b* for an exit through which the power cable 102*a* is extracted. A concavity 101*c* adjacent to the hole 101*b* is formed in the upper housing 101 for accommodating the plug 102 when the power cable 102*a* has been retracted. The lower housing 103 has a hole 103*a* for pulling out the power cable 104*a*. A concavity 103*b* adjacent to the hole 103*a* is formed in the lower housing 103 to accommodate the plug 104 when the power cable 104*a* has been retracted. An unused portion of the power cable 102*a* is rolled around cylinders 108*a* and 108*b* in the housing. The torsion spring 110*a* is secured between the cylinder 108*a* and a rotation shaft 112*a* to make the cylinder 108*a* wind up the power cable 102*a*. The torsion spring 110*b* is secured between the cylinder 108*b* and a rotation shaft 112*b* to make the cylinder 108*b* wind up the power cable 102*a*. The rotation shaft 112*a* is fixed on frames 118*a* and 118*b*. An unused portion of the power 104*a* is rolled around the cylinder 108*c* in the housing. The torsion spring 110*c* is secured between the cylinder 108*c* and the rotation shaft 112*b* to make the cylinder 108*c* wind up the power cable 104*a*. Cylinders 108*a* and 108*c*, equipped with teeth, are secured to a lower housing 103 by the same rotation shaft 112*b*. Cylinders 108*a*, 108*b* and 108*c* are driven by torsion springs to wind up power cables. Rotation of cylinders 108*a*, 108*b* and 108*c* is blocked by a stop 122, when the adapter module is in use. The stop 122 is secured to the lower housing 103 by means of screws 124, and a gap is left so the stop can be controlled by the button 106. The stop 122, driven by a spring 120, stops rotation of cylinders 114*b* and 114*c*. When the adapter module 100 is assembled, the spring 120 is accommodated in a hollow cylinder 126. When the button 106 is pressed by a user, the stop 122 is released from teeth of cylinders 108*b* and 108*c*, and power cables 102*a* and 104*a* are retracted by rotating cylinders 108*b* and 108*c*.

According to the preferred embodiments, the adapter module for portable computer withdraws its power cables by an automatic rolling function. When the adapter module is in use, power cables of a desired length are pulled out and unused portions of power cables are kept in the housing. When power cables have been retracted, plugs thereof are accommodated in concavities thereof, effectively reducing an overall storage volume thereof.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An adapter module, comprising:

a housing;

a first power cable, having a first plug to connect with a power source;

a second power cable, having a second plug to connect with a portable computer;

a first cylinder, installed in said housing, said first cylinder including a first torsion spring;

a second and a third cylinder equipped with teeth, said second cylinder and said third cylinder being installed in said housing with a same rotation shaft, said second cylinder and said third cylinder respectively having a second torsion spring and a third torsion spring, wherein said first cylinder and said second cylinder are aligned to roll up said first power cable, said first power cable is wound around said first cylinder and said second cylinder, and said third cylinder is used to roll said second power cable, said second power cable being wound around said third cylinder;

a stop, driven by a spring to block said teeth of said second cylinder and said third cylinder, respectively, whereby said second cylinder and said third cylinder are prevented from rolling; and a button, pressed by a user against said spring's force to release said stop, wherein:

when the adapter module is in use, said first and second plugs are respectively pulled to extract said first and second power cables from said housing; and when the adapter module is not in use, said button is pressed to enable said second cylinder and said third cylinder to retract said first and second power cables into said housing.

2. The adapter module of claim 1, wherein said housing has a first hole to expose said button.

3. The adapter module of claim 2, wherein said housing has a second hole serving as an exit, and said first power cable is extracted through said second hole.

4. The adapter module of claim 3, wherein said housing has a third hole serving as an exit, and said second power cable is extracted through said third hole.

5. The adapter module of claim 1, further comprising a hollow cylinder in said housing to accommodate said spring.

6. The adapter module of claim 1, wherein said stop is secured in said housing by means of screws.

7. An adapter module, comprising:

a lower housing;

a first power cable, having a first plug to connect with a power source;

a second power cable, having a second plug to connect with a portable computer;

a first cylinder, installed in said lower housing, said first cylinder including a first torsion spring;

a second and a third cylinder equipped with teeth, said second cylinder and said third cylinder being installed in said lower housing with a same rotation shaft, and said second cylinder and said third cylinder respectively having a second torsion spring and a third torsion spring, wherein said first cylinder and said second cylinder are aligned to roll up said first power cable, said first power cable is wound around said first cylinder and said second cylinder, and said third cylinder is used to roll up said second power cable, said second power cable being wound around said third cylinder;

a stop, driven by a spring to block said teeth of said second cylinder and said third cylinder, respectively, whereby said second cylinder and said third cylinder are prevented from rolling;

a button, pressed by a user against said spring's force so as to release said stop; and an upper housing, assembled with said lower housing to accommodate components thereof, wherein:

when the adapter module is in use, said first and second plugs are respectively pulled to extract said first and second power cables; and when the adapter module is not in use, said button is pressed to enable said second cylinder and said third cylinder to retract said first and second power cables.

8. The adapter module of claim 7, wherein said upper housing has a first hole to expose said button.

9. The adapter module of claim 8, wherein said upper housing has a second hole serving as an exit, and said first power cable is extracted through said second hole.

10. The adapter module of claim 9, wherein said lower housing has a third hole serving as an exit, and said second power cable is extracted through said third hole.

11. The adapter module of claim 7, wherein said upper housing has a first concavity to accommodate said first plug when said first power cable has been retracted.

12. The adapter module of claim 7, wherein said lower housing has a second concavity to accommodate said second plug when said second power cable has been retracted.

13. The adapter module of claim 7, further comprises a hollow cylinder in said lower housing to accommodate said spring.

14. The adapter module of claim 7, wherein said stop is secured in said lower housing by means of screws.

* * * * *